US011672352B2

(12) United States Patent
Godard

(10) Patent No.: US 11,672,352 B2
(45) Date of Patent: Jun. 13, 2023

(54) PALM SUPPORT DEVICE

(71) Applicant: Muskoka Research Inc., Bala (CA)

(72) Inventor: Eric Godard, Toronto (CA)

(73) Assignee: Muskoka Research Inc., Bala (CA)

( * ) Notice: Subject to any disclaimer, the term of this patent is extended or adjusted under 35 U.S.C. 154(b) by 0 days.

(21) Appl. No.: 17/370,031

(22) Filed: Jul. 8, 2021

(65) Prior Publication Data

US 2023/0011403 A1 Jan. 12, 2023

(51) Int. Cl.
*A47C 16/00* (2006.01)
*A47B 97/00* (2006.01)

(52) U.S. Cl.
CPC ..... *A47C 16/00* (2013.01); *A47B 97/00* (2013.01); *A47B 2200/0084* (2013.01)

(58) Field of Classification Search
CPC ..... A47C 16/00; A47C 16/02; A47B 97/00; A47B 2200/0084; A45D 29/22
USPC ..... 248/118, 118.1, 118.5; 132/73, 285, 132/76.5, 73.5
See application file for complete search history.

(56) References Cited

U.S. PATENT DOCUMENTS 2,336,707 A * 12/1943 Thompson ..... A47C 7/383 5/636
2,719,577 A * 10/1955 Eyman ..... B61D 33/005 5/640
5,131,614 A 7/1992 Garcia
5,165,630 A * 11/1992 Connor ..... A47B 21/0371 248/118.1
5,386,957 A 2/1995 Miller
5,398,896 A * 3/1995 Terbrack ..... A47B 21/0371 248/118
5,433,407 A 7/1995 Rice
5,490,647 A 2/1996 Rice
5,522,572 A 6/1996 Copeland
5,562,270 A 10/1996 Montague
5,566,913 A 10/1996 Prokop
5,892,499 A 4/1999 Vulk, Jr.
(Continued)

FOREIGN PATENT DOCUMENTS

CN 2379827 5/2000
JP 2002341996 A 11/2002
(Continued)

OTHER PUBLICATIONS

Registration No. DM/214267 , owner Deltahub d.o.o Dec. 5, 2021, https://www3.wipo.int/designdb/hague/en/showData.jsp?&SOURCE=HAGUE&LANG=en&KEY=DM/214267.
(Continued)

*Primary Examiner* — Nkeisha Smith
(74) *Attorney, Agent, or Firm* — Rowand LLP

(57) ABSTRACT

A support device for ergonomic support of a user's hand during operation of a hand-operated input device, such as a computer mouse. The device includes a left pad and a right pad, spaced apart by a hinge that enables the pads to fold into a closed configuration for transport or storage. The hinge may be a living hinge integrally formed with at least a portion of the left and right pads. The pads support the pisiform and trapezium regions of the heel of the hand, respectively, and are configured to slide on a work surface. The device may include a latching mechanism, such a magnetic latch, to releasably hold the device in the closed configuration when not in use.

21 Claims, 7 Drawing Sheets

(56) References Cited

U.S. PATENT DOCUMENTS

| | | | | |
|---|---|---|---|---|
| 5,944,289 | A | 8/1999 | Speece | |
| 6,170,908 | B1 * | 1/2001 | Jewell | A47C 17/045 297/118 |
| 6,247,672 | B1 * | 6/2001 | Bello | A47C 16/00 248/118.1 |
| 6,336,614 | B1 * | 1/2002 | Kwitek | G06F 1/169 361/679.19 |
| 7,183,523 | B2 | 2/2007 | Lu | |
| 8,151,389 | B1 * | 4/2012 | Lando | A47D 15/005 5/655 |
| 8,234,819 | B2 * | 8/2012 | Petrov | E04D 13/076 52/16 |
| 9,596,942 | B2 * | 3/2017 | Kubota | A47C 7/383 |
| 2002/0162919 | A1 | 11/2002 | Kuo | |
| 2003/0169236 | A1 * | 9/2003 | Crocker | G06F 3/0202 345/168 |
| 2003/0209641 | A1 | 11/2003 | Cooke | |
| 2004/0226096 | A1 * | 11/2004 | Davis | A47C 16/02 5/632 |
| 2006/0226305 | A1 | 10/2006 | Sheybani | |
| 2008/0001042 | A1 | 1/2008 | Quiroga | |
| 2008/0256714 | A1 * | 10/2008 | Cubbage | A47C 31/11 5/656 |
| 2012/0305715 | A1 | 12/2012 | Lucas | |
| 2019/0174923 | A1 * | 6/2019 | Osti | A47C 7/024 |
| 2020/0221888 | A1 * | 7/2020 | Cable | A47C 16/00 |

FOREIGN PATENT DOCUMENTS

| | | |
|---|---|---|
| WO | WO1993013515 A1 | 7/1993 |
| WO | WO2009059492 | 5/2009 |

OTHER PUBLICATIONS

International Search Report & the Written Opinion dated Sep. 1, 2022; WIPO Application No. PCT/CA2022/051061.

* cited by examiner

PALM SUPPORT DEVICE

TECHNICAL FIELD

The present disclosure relates to a support device for the palm or wrist when operating an input device on a work surface, such as a computer mouse, keyboard, or the like.

BACKGROUND

Hand-operated input devices can include a computer mouse, trackball, trackpad, keyboard, drawing pad, or the like. Use, or over use, of these devices can put stress on parts of the hand or wrist that may lead to compression injuries, such as carpal tunnel syndrome (CTS) or ulnar tunnel syndrome (UTS). Ergonomic support devices have been developed for the wrist or palm in connection with hand-operated input devices. One example support device is an elongated pad fixed in front of a keyboard upon which a user may rest their palms and/or wrists when typing. Another example ergonomic support device is a mouse pad that incorporates a raised wrist or palm support pad fixed to one end of the mouse pad. Ergonomic supports for the hands or wrists are also sometimes incorporated into keyboard trays or desk tops.

BRIEF DESCRIPTION OF THE DRAWINGS

Embodiments will be described, by way of example only, with reference to the accompanying figures wherein.

DETAILED DESCRIPTION

Figure 1:
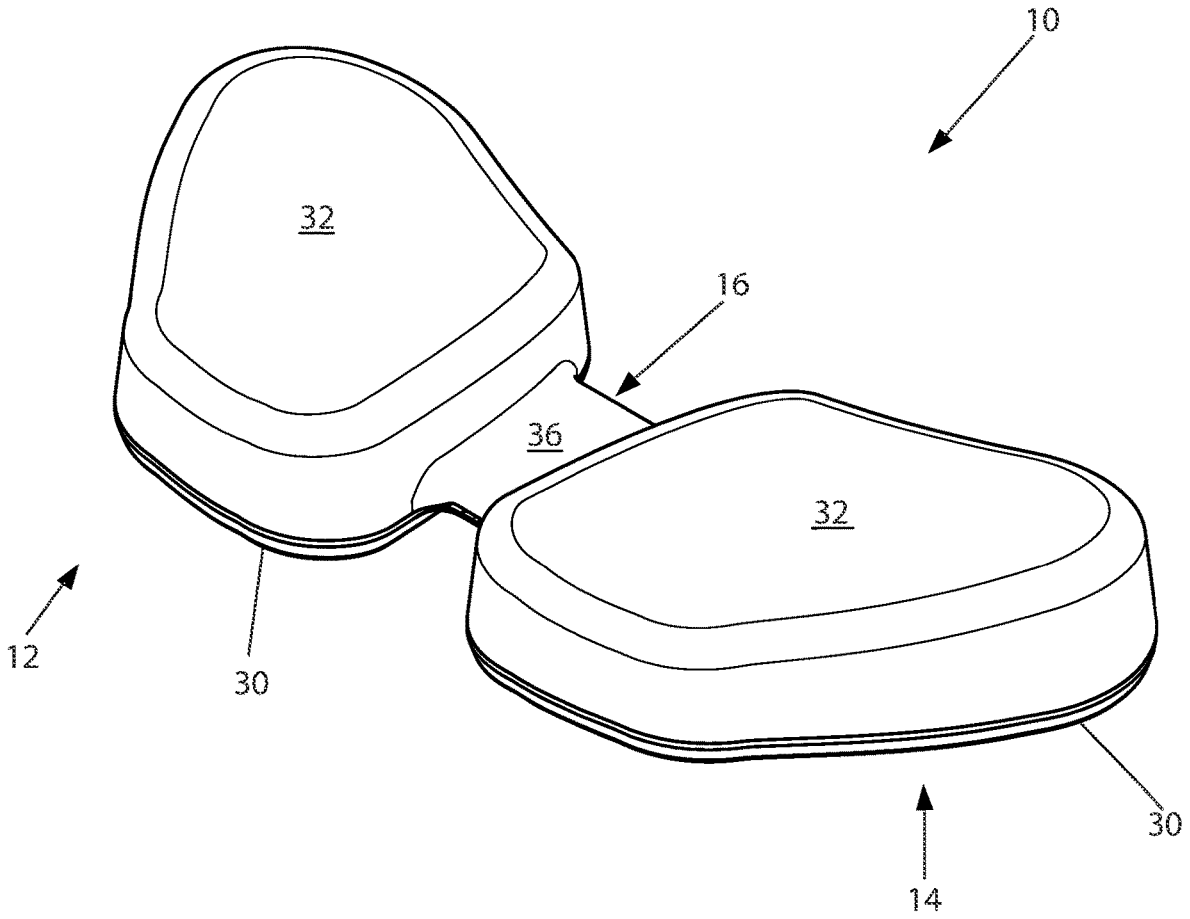
FIG. 1 shows a palm support device in accordance with one example embodiment in perspective view in an open or operating configuration.

In one aspect, the present application discloses a palm support device for use in supporting a user's hand while operating an input device on a work surface. The palm support device may include two support pads each having an underside to slidably contact the work surface and an upper surface to contact and support, in use, a pisiform region of the hand and a trapezium region of the hand, respectively; and a hinge connecting the two pads to provide for hinged movement of the two pads relative to each other between an open configuration in which the two pads are spaced-apart and in a common plane and a closed configuration in which the two pads are brought into contact with each other.

In some implementations, the hinge includes a living hinge. The living hinge may be integrally formed with and connect the two support pads. In some cases, the two support pads include a support pad portion and a base portion, wherein the base portion includes a left part, a right part and a connecting web connecting the left part to the right part, and wherein the connecting web forms the living hinge. In some cases, the support pad portion is bonded atop the left part and the right part of the base portion and provides the upper surface to contact and support the pisiform region and the trapezium region.

In some implementations, the support pads may be at least partly formed from a material having a Shore durometer of between 20 and 50 using an A-type scale.

In some implementations, at least a portion of the support pads may be formed from liquid silicone rubber.

In some implementations, at least a portion of the support pads may be formed from one or more of polypropylene, polyethylene, and polytetrafluoroethylene.

In some implementations, the palm support device may further include a latching mechanism for releasably maintaining the palm support device in the closed configuration. In some cases, the latching mechanism may be a magnetic latch.

In some implementations, the magnetic latch may include at least one permanent magnet within one of the two support pads.

In some implementations, when in the closed configuration, the undersides of the two pads are brought into contact with each other.

In some implementations, the upper surface of each of the two support pads may be contoured to conform to a shape of a heel of the hand.

In some implementations, each of the two support pads may have a concave upper surface. In some cases, each of the concave upper surfaces has an outermost edge higher than an inner edge.

In some implementations, each of the two support pads has a generally rounded rectangular main area and a wing extending outwardly and distally.

In some implementations, the hinge connecting the two support pads is lower than the upper surface of the two support pads, providing an air gap between the two support pads when spaced apart in the open configuration.

In yet another aspect, the present application describes a palm support device for use in supporting a heel of a user's hand while operating a hand-operated input device on a work surface. The palm support device may include a base portion having a left part and a right part spaced-apart and connected by a connecting web, wherein the base portion is integrally formed, the left part and the right part having an underside for contacting the work surface, and wherein the connecting web forms a living hinge to enable hinged movement of the left part and the right part between an open configuration in which the undersides are in a common plane and a closed configuration in which the undersides are brought into contact with each other; a support pad portion having a left side and a right side spaced-apart and bonded atop the left part and the right part of the base portion, respectively, the left side and right side of the support pad portion each having an upper surface to contact and support, in use, a pisiform region of the hand and a trapezium region of the hand, respectively; and a latching mechanism for releasably maintaining the base portion in the closed configuration.

In some implementations, the living hinge is in a plane above the common plane and below the upper surface.

In some implementations, the upper surface of each of the left side and right side of the support pad portion is concave.

Other example embodiments of the present disclosure will be apparent to those of ordinary skill in the art from a review of the following detailed descriptions in conjunction with the drawings.

In the present application, the term "and/or" is intended to cover all possible combinations and sub-combinations of the listed elements, including any one of the listed elements alone, any sub-combination, or all of the elements, and without necessarily excluding additional elements.

In the present application, the phrase "at least one of . . . and . . . " is intended to cover any one or more of the listed elements, including any one of the listed elements alone, any sub-combination, or all of the elements, without necessarily excluding any additional elements, and without necessarily requiring all of the elements.

Persons engaged in operating computing devices in a work environment commonly employ some form of ergonomic support device for the wrist or palm in connection with hand-operating input devices. Hand-operated input devices can include a computer mouse, trackball, trackpad, keyboard, drawing pad, or the like. Stress on the hands or wrist from hand-operated input devices can result in compression injuries, such as carpal tunnel syndrome (CTS) or ulnar tunnel syndrome (UTS). A typical ergonomic support device includes an elongated pad fixed in front of a keyboard upon which a user may rest their palms and/or wrists when typing. Another typical ergonomic support device is a mouse pad that incorporates a wrist or palm support fixed to the mouse pad. Ergonomic supports for the hands or wrists are also sometimes incorporated into keyboard trays or desk tops.

The past few years has seen a growth in different work models, including work-from-home, hoteling, and hybrid models in which people may change the location of their workspace frequently. The COVID-19 pandemic has greatly accelerated the transition to work-from-home and hybrid work solutions. It is now more important than ever that people are able to transition between a variety of work environments, some of which may be non-traditional.

This transition to a fluid work environment will exacerbate ergonomic problems, as it is typically not possible to transport all ergonomic equipment from space to space.

Figure 2:
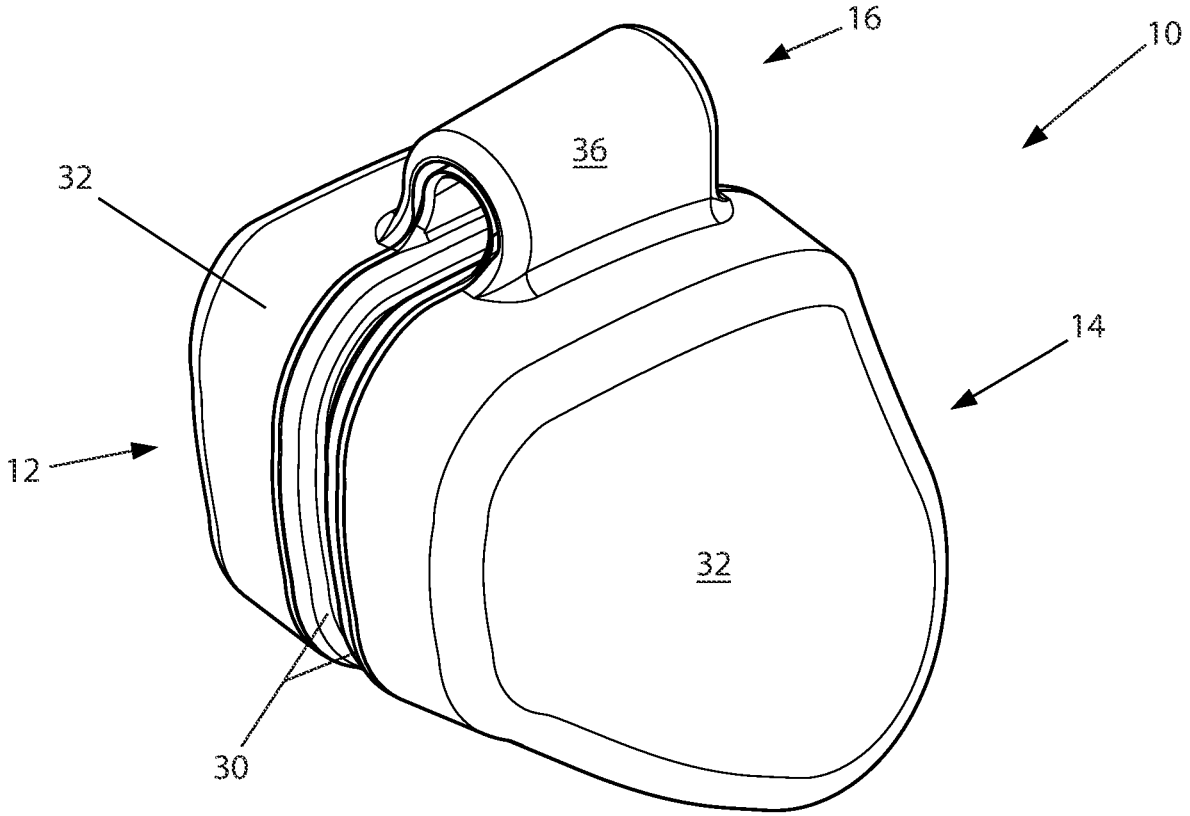
FIG. 2 shows the palm support device in perspective view in a closed configuration.
Figure 3:
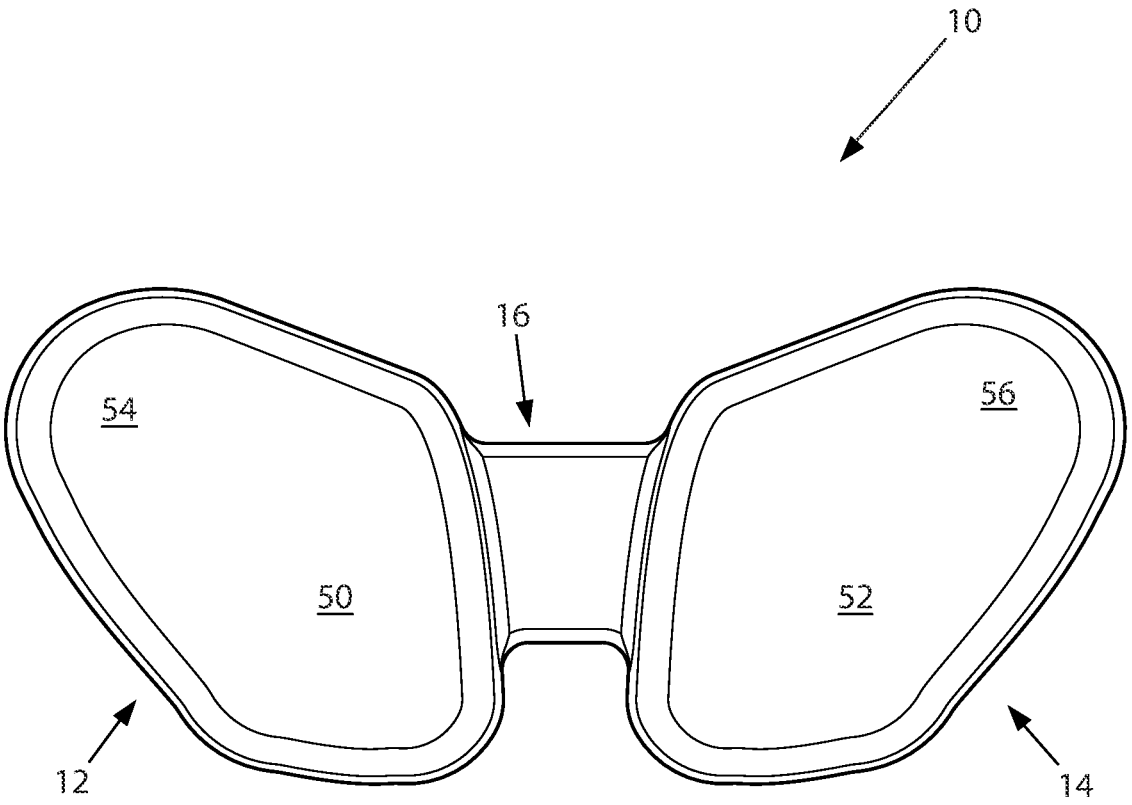
FIG. 3 shows a plan view of the outline of the example palm support device in its operating configuration.
Figure 4:
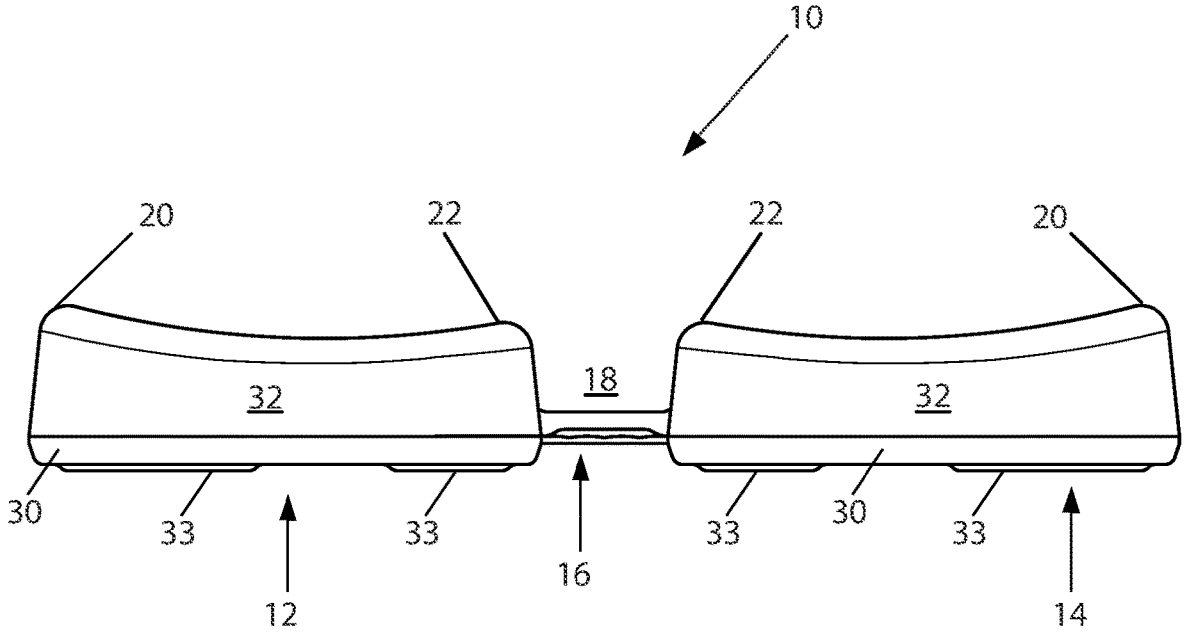
FIG. 4 shows a front view of the palm support device in its operating configuration.
Figure 5:
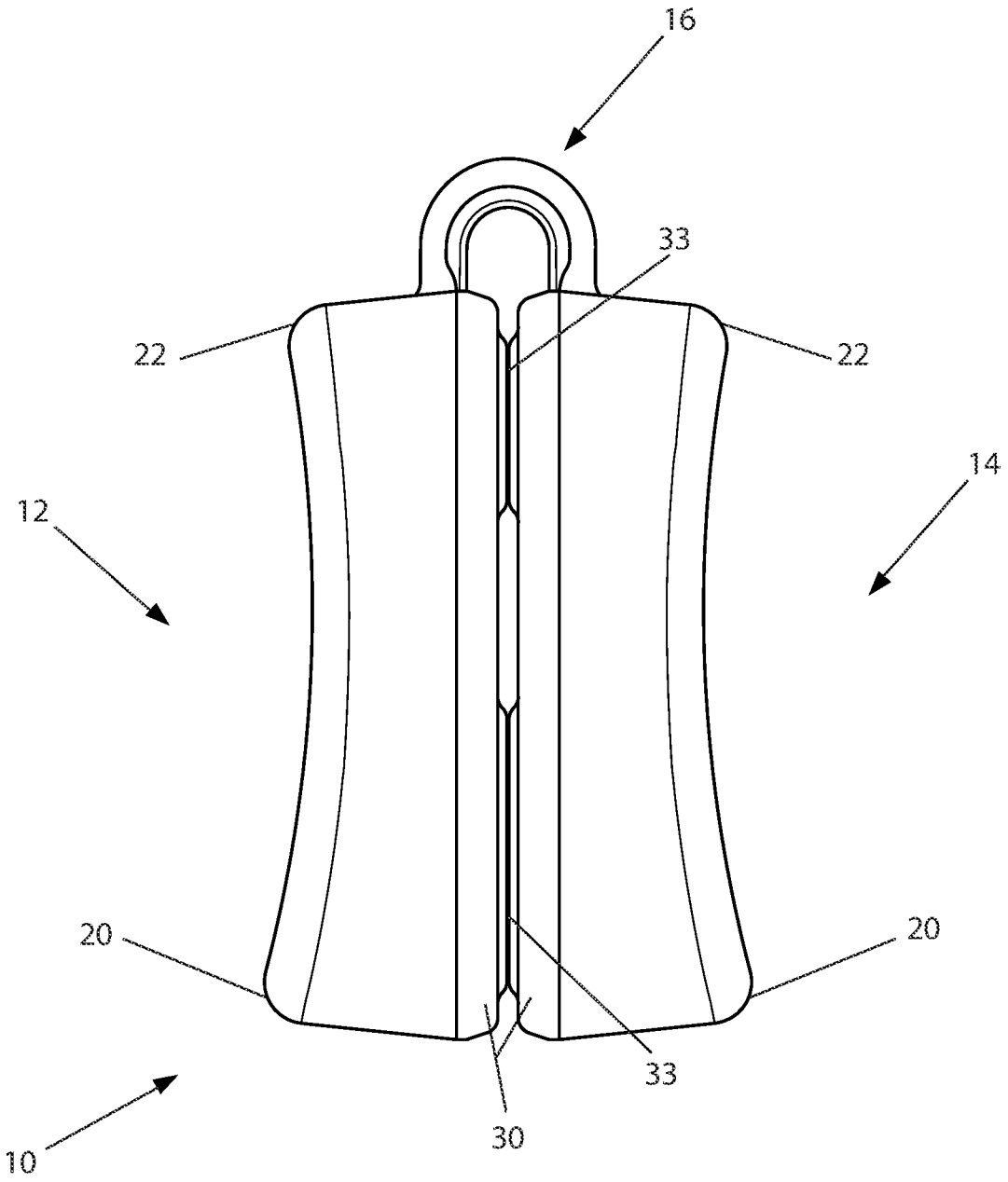
FIG. 5 shows a front view of the palm support device 10 in its closed configuration.

In one aspect, the present application describes a palm support for hand-operated input devices, such as a computer mouse or the like. Reference will now be made to FIGS. 1-5 which show various views of an example of a palm support device 10. In particular, FIG. 1 shows the palm support device 10 in perspective view in an open or operating configuration. FIG. 2 shows the palm support device 10 in perspective view in a closed configuration. FIG. 3 shows a plan view of the outline of the palm support device 10 in its operating configuration. FIG. 4 shows a front view of the palm support device 10 in its operating configuration. FIG. 5 shows a front view of the palm support device 10 in its closed configuration.

The palm support device 10 includes a first pad 12 and a second pad 14 connected by a bridge 16. The pads 12, 14 are spaced apart by the bridge 16. The pads 12, 14 are configured to support the palm of a user's hand whilst the user is operating a hand-held input device. In particular, the first pad 12 provides a left side support and the second pad 14 provides right side support for the heel portion of the palm of a user's hand.

The bridge 16 is a connecting piece between the spaced-apart pads 12, 14 that is thinner in its height than the pads 12, 14 and is narrower in its width than the pads 12, 14, i.e. the bridge 16 sits below the upper surface of the pads 12, 14. The spacing apart of the pads 12, 14 and the thinner configuration of the bridge 16 results an air gap 18 above the bridge 16 and between the pads 12, 14, as best seen in FIG. 4.

The undersides of the spaced-apart pads 12, 14 lie in a common plane intended to slide atop the work surface in the open configuration. The bridge 16 may be configured to lie in a plane above the common plane so that the bridge 16 does not contact the work surface. In other words, the bridge 16 may be positioned between and apart from the underside of the pads 12, 14 and the upper surface of the pads 12, 14.

Figure 6:
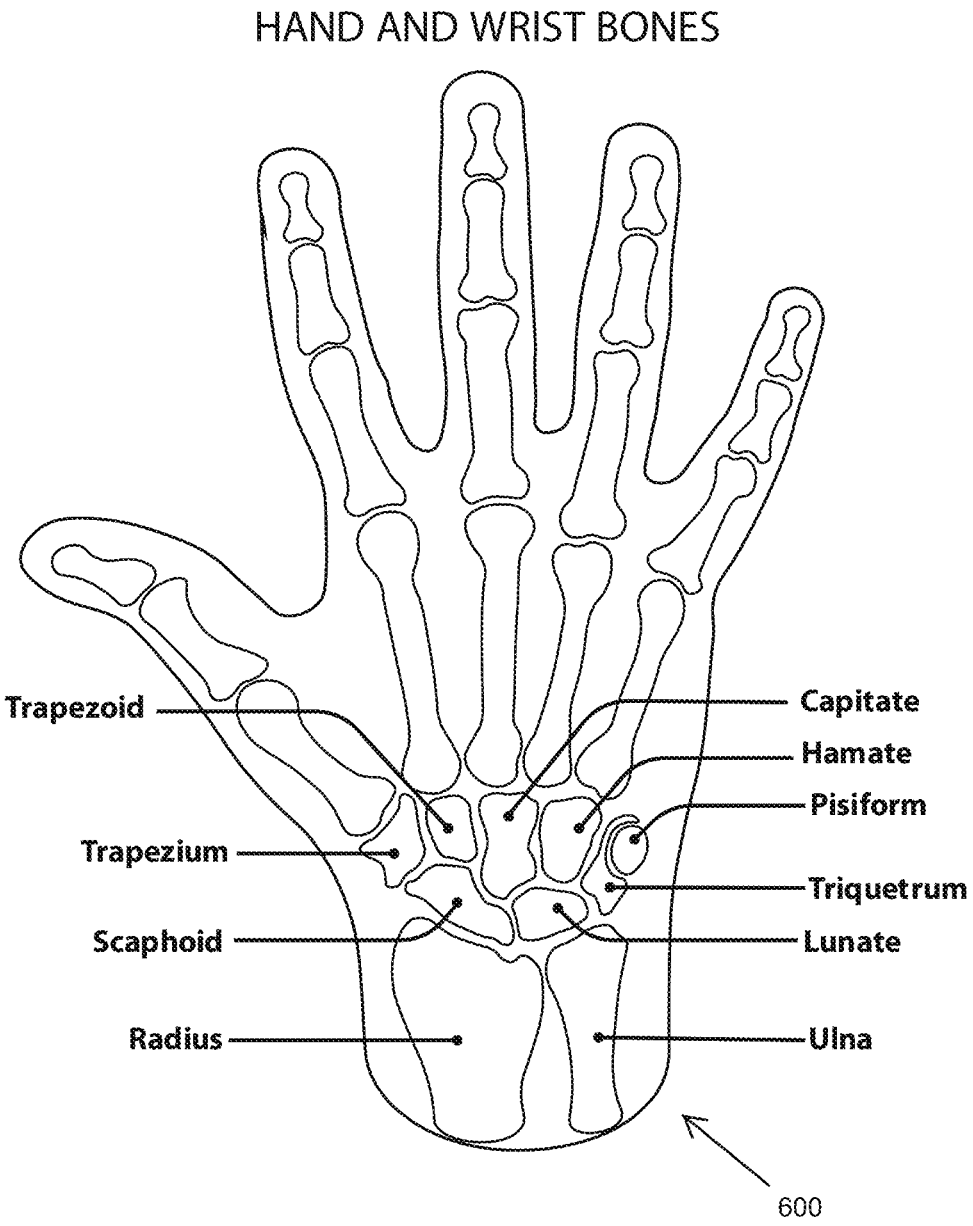
FIG. 6 shows an illustration of the bones of a human hand.

Reference is now also made to FIG. 6, which shows an illustration of the bones of a human hand 600. The view shown in FIG. 6 is a dorsal view of a right hand, i.e. the back of the hand 600. The bones of the forearm that connect to the hand include the radius and the ulna. The carpal bones that make up the wrist include the trapezium, the trapezoid, the capitate, the hamate, the pisiform, the triquetrum, the lunate, and the scaphoid. It will be noted that the outer left-most and right-most regions of the palm i.e. the underside of the view shown, correspond generally to the position of the trapezium and the pisiform, respectively.

The carpal bones form an arch referred to as the carpal tunnel, through which various nerves and muscle tendons pass. The open side of the arch in the area of the palm, i.e. sometimes referred to as the heel of the hand, is enclosed by the flexor retinaculum. The flexor retinaculum is a sheath of connective tissue attached to the trapezium and scaphoid and to the pisiform and hamate bones.

Some repetitive stress movements may place stress or compression on the flexor retinaculum or otherwise compress the carpal tunnel in a manner that impacts upon the muscle tendons or nerves passing through the tunnel and causing pain or discomfort.

Referring again to FIGS. 1-5, the pads 12, 14 are sized and spaced to generally contact and support a user's palm, e.g. heel of the hand, in the pisiform region and the trapezium region, respectively. The pisiform region may include the area of the heel of the hand generally proximate the pisiform bone. This may include the portion of the heel of the hand proximate the triquetrum bone and/or hamate bones to the extent they extend towards the palm/heel area and/or connect to the flexor retinaculum. The trapezium region may include the area of the heel of the hand generally proximate the trapezium bone. This may include the portion of the heel of the hand proximate the scaphoid bone to the extent that it extends towards the palm/heel area and/or connects to the flexor retinaculum.

By providing for support in the two spaced-apart regions of the palm, the pads 12, 14 and the air gap 18 may assist in gently stretching and relieving pressure upon the flexor retinaculum in the open region of the carpal tunnel. The air gap 18 may further provide for airflow in the region of the palm to cool the user's hand when using the hand-operated input device. The air gap 18 and bridge 16 configuration separating the pads 12, 14 may further reduce material waste in forming the palm support device 10.

In some implementations, the underside of the palm support device 10 may be configured to slide easily on a work surface so as to move with the user's hand as the hand-operated input device is manipulated.

The upper surface of the pads 12, 14 may be flat, e.g. parallel to the work surface upon which the palm support device 10 is placed, in some implementations. In other implementations, the upper surface of the pads 12, 14 may be contoured. The shape of the contoured upper surface may be based on the general shape of the pisiform region and trapezium region of the hand, respectively. As shown in FIGS. 4 and 5, each upper surface may have a slightly concave contour to mold to the portion of the heel of the hand that it supports. The thickness of the pad 12, 14 at an outermost edge 20 may be higher than the thickness of the pad 12, 14 at an inner edge 22, with the surface of the pad having a gentle concave shape between those points.

In one implementation, the pads 12, 14 may be customized to a specific user. Laser scanning or other types of three-dimensional measurement may be used to obtain contour data regarding a user's palm shape when in an operating position, e.g. while operating a hand-operated input device like a computer mouse. The scan data may be used to generate a corresponding contour profile for the pads 12, 14.

In some example embodiments, the palm support device 10 is molded as a single piece. The palm support device 10 may be created from suitable plastic or rubber, for instance. In some cases, silicone rubber may be used to mold the palm support device 10. In some cases, the palm support device 10 may be molded from a plastic polymer, such as polypropylene or polyethylene.

It may be advantageous to provide for a low friction surface on the underside of the palm support device 10 to ensure it glides smoothly and easily on a work surface. The material forming for the palm support device 10 may be selected based on it having a low coefficient of friction. In some cases, the underside of the palm support device 10 may be coated with a substance that provides a low coefficient of friction, such as polytetrafluoroethylene, like Teflon™ marketed by The Chemours Company.

In some cases, a lower coefficient of friction may be, at least in part, achieved through providing the underside of the palm support device 10 with runners 33 to reduce the surface area of the palm support device 10 in contact with the work surface. The palm support device 10 may include two or more runner 33 per side. In some cases, runners 33 may be place near the four curved corners of each of the pads 12, 14. In some cases, instead of runners 33, the underside of the pads 12, 14, may feature nubs or dimpling or other surface projections that server to reduce the surface area of the palm support device 10 in contact with the work surface. In some implementations, the runners 33 or other projections are formed integrally with the underside of the pads 12, 14.

In some cases, the underside of the palm support device 10 may include one or more cavities that accommodates ball bearing assemblies (not shown) to facilitate friction free sliding or gliding of the palm support device 10. Other mechanisms for reduction of friction and enablement of sliding movement will be appreciated in light of the description herein.

It may be advantageous in some cases to form the palm support device 10 from two or more parts. As shown in FIGS. 1-5, in this example embodiment the palm support device 10 includes a base portion 30 and a support pad portion 32. The base portion 30 may be formed from a low friction plastic with a low coefficient of friction in some examples, whilst the support pad portion 32 may be formed from a higher friction natural or synthetic material to avoid slippage of the user's palm on the device. In some cases, the support pad portion 32 may be formed from a synthetic foam or a synthetic rubber. In some cases, the support pad portion 32 may be molded from a liquid silicone rubber. To provide sufficient support and comfort in some embodiments the support pad portion 32 may have a Shore durometer of between 20-50 using an A-type scale. In some implementations, the material may have a Shore durometer of between 25-35 on the A-type. In some implementations, the material may have a durometer reading on the 00-type scale.

The base portion 30 and the support pad portion 32 may be bonded together using any suitable mechanisms depending on their respective materials, including mechanical engagement, heat bonding, or chemical bonding (e.g. adhesives).

In another aspect, some embodiments of the palm support device 10, like those shown in FIGS. 1-5, may be configured to fold from the operating configuration shown in FIG. 1 to the closed configuration shown in FIG. 2. The closed configuration may make the palm support device 10 more compact for transport, storage, shipping, and the like. Moreover, the closed configuration may protect the low friction surface of the base portion 30 when being transported, stored, shipped, etc.

To facilitate the folding of the palm support device 10 the bridge 16 may serve as a hinge. In some implementations, the bridge 16 may incorporate one or mechanical hinges (not shown) to facilitate movement between the open and closed configurations. In this example, however, the bridge 16 is formed as a living hinge. That is, the bridge 16 is formed from a material, such as the base portion 30 material, like polypropylene or polyethylene, having a thickness that enables it to flex and bend, as shown in FIGS. 2 and 5.

The living hinge may be formed to be resiliently biased in the open configuration shown in FIGS. 1 and 4. That is, when in the closed configuration, the living hinge may be biased to urge the pads 12, 14 back into the open configuration. Accordingly, the palm support device 10 may further incorporate a latching mechanism to releasably maintain the palm support device 10 in the closed configuration. In some cases, the latching mechanism may include a mechanical latch, such as a clasp or button, that may be fastened to hold the pads 12, 14 in the closed configuration.

In this example, the latching mechanism includes a magnetic closure. That is, one of the pads 12, 14 includes a permanent magnet and the other of the pads 12, 14 includes a ferromagnetic material, such as iron, steel, nickel, etc. that will be attracted to the permanent magnet when brought into close proximity. The permanent magnet may be a ferrite magnet in some cases. It may be a neodymium-based magnet in some cases. Other types of magnets may be used in some applications. In some cases, instead of a ferromagnetic material, the other of the pads 12, 14 may include a second permanent magnet, provided the polarizations of the two magnets are configured to ensure that they attract rather than repel each other.

Figure 7:
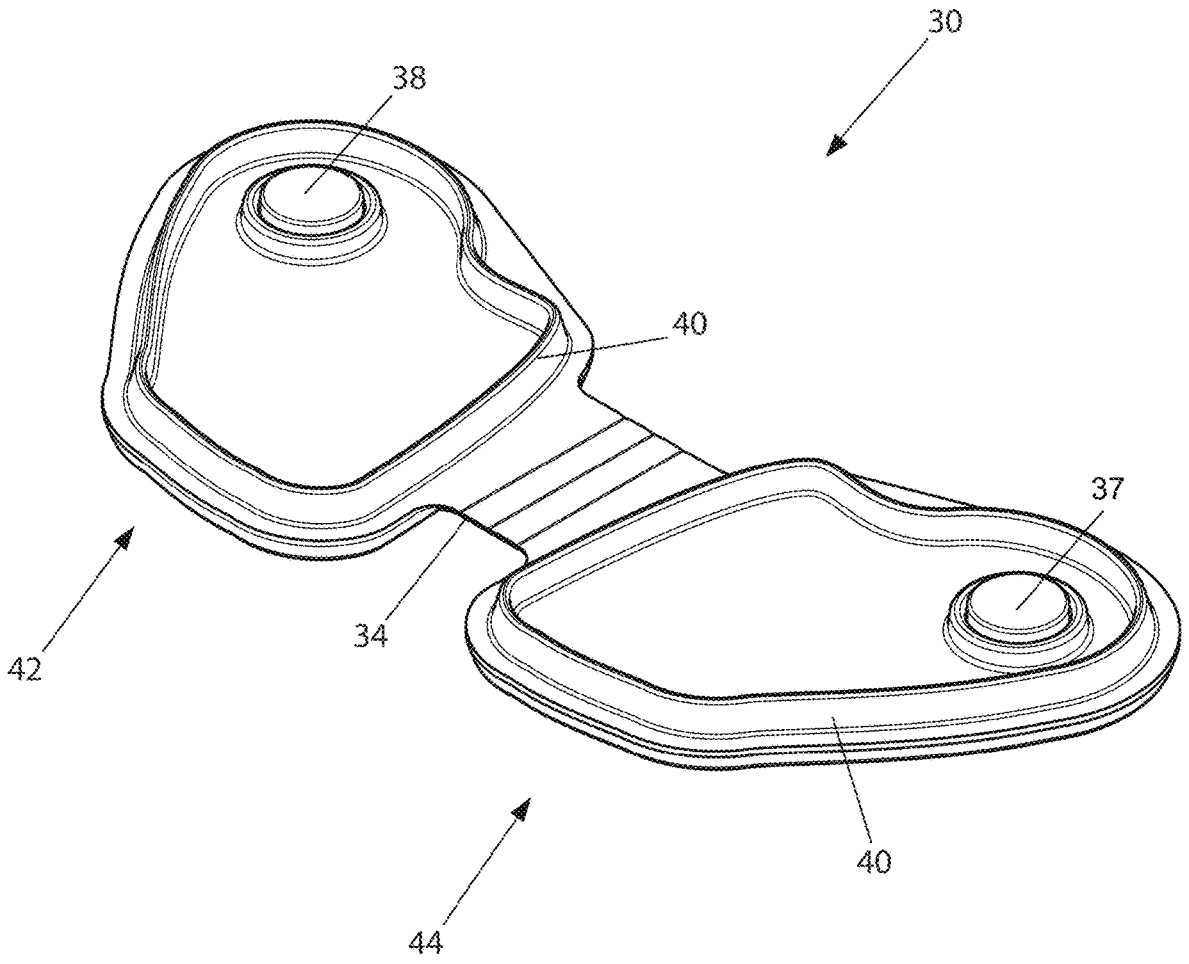
FIG. 7 shows a perspective view of an example base portion of the palm support device.

FIG. 7 illustrates on example embodiment of the base portion 30 of palm support device. The base portion 30 includes a left part 42 and a right part 44 integrally formed with and separated by a connecting web 34. The connecting web 34 forms the living hinge of the bridge 16. It is of a thickness and width sufficient to provide biased resiliency to deformation but thin enough to resiliently flex between the open and closed configurations. The base portion 30 may be formed through injection molding in some cases.

The left part 42 and the right part 44 may include circumferential flanges 40 that provide structural strength to the base portion 30. Left side and right side parts of the support pad portion 32 (FIG. 1) may be bonded atop the left part 42 and the right part 44 using adhesive or other bonding material, such that the support pad portion 32 envelopes and covers the circumferential flanges 40.

Each of the left part 42 and right part 44 of the base portion 30 may include a magnetic latch area. In this example, the magnetic latch area is defined by a circular ridge within which a permanent magnet 37 or ferromagnetic material 38 may be attached. When folded in the closed configuration, the two magnetic latch areas are brought into close proximity, such that the ferromagnetic material 38 is sufficiently attracted to the permanent magnet 37 to resiliently hold the palm support device 10 in the closed configuration.

Referring again to FIGS. 1-5, it will be noted that in this example illustration support pad portion 32 of the pads 12, 14 are formed as a unitary item with a connecting strap 36 extending between the left side and right side of the support pad portion 32 over top of the connecting web 34 of the base portion 30. In some implementations, the connecting strap 36 may be omitted and the living hinge of the bridge 16 formed entirely from the connecting web 34. In some cases, the connecting strap 36 may be adhesively bonded to the connecting web 34, thereby providing additional structural support to the connecting web 34 in forming the living hinge. In some cases, the connecting strap 36 may not be bonded or otherwise connected to the connecting web 34. In some cases, a small gap may be provided between the underside of the connecting strap 36 and the top of the connecting web 34, when in an open configuration.

Referring now to FIG. 3, it will be appreciated that the pads 12, 14 in this example embodiment each include a somewhat rounded rectangular main areas 50, 52. The shape of the pads 12, 14 then further respectively includes wings 54 and 56 extending outwardly and distally. The resultant shape of the pads 12, 14 models the outward distal spread of the palm, and particularly the heel, of the hand. The wings 54, 56 in particular may provide lateral support as the hand is rotated or rocked slightly to the left or right while operating the hand-operated input device.

In some implementations, other shapes for the pads 12, 14 may be adopted, including circular, rectangular, square, trapezoidal, irregular, etc., with or without rounded corners and with or without a contoured top surface.

The above discussed embodiments are considered to be illustrative and not restrictive. Certain adaptations and modifications of the described embodiments may be made. All such modification, permutations and combinations are intended to fall within the scope of the present disclosure.

The invention claimed is:

1. A palm support device for use in supporting a user's hand while operating an input device on a work surface, comprising:

two support pads each having an underside having a low friction surface to slide on the work surface and an upper surface to contact and support, in use, a pisiform region of the hand and a trapezium region of the hand, respectively; and a hinge connecting the two pads to provide for hinged movement of the two pads relative to each other between an open configuration in which the two pads are spaced-apart and in a common plane and a closed configuration in which the two pads are brought into contact with each other, and wherein, when in the closed configuration, the undersides of the two pads are brought into contact with each other.

2. The palm support device of claim 1, wherein the hinge includes a living hinge.

3. The palm support device of claim 2, wherein the living hinge is integrally formed with and connects the two support pads.

4. The palm support device of claim 3, wherein the two support pads include a support pad portion and a base portion, wherein the base portion includes a left part, a right part and a connecting web connecting the left part to the right part, and wherein the connecting web forms the living hinge.

5. The palm support device of claim 4, wherein the support pad portion is bonded atop the left part and the right part of the base portion and provides the upper surface to contact and support the pisiform region and the trapezium region.

6. The palm support device of claim 5, wherein the support pad portion is formed from a material having a Shore durometer of between 20 and 50 using an A-type scale.

7. The palm support device of claim 5, wherein the support pad portion is formed from liquid silicone rubber.

8. The palm support device of claim 5, wherein the base portion is formed from one or more of polypropylene, polyethylene, and polytetrafluoroethylene.

9. The palm support device of claim 1, further comprising a latching mechanism for releasably maintaining the palm support device in the closed configuration.

10. The palm support device of claim 9, wherein the latching mechanism comprises a magnetic latch.

11. The palm support device of claim 10, wherein the magnetic latch includes at least one permanent magnet within one of the two support pads.

12. The palm support device of claim 1, wherein the upper surface of each of the two support pads are contoured to conform to a shape of a heel of the hand.

13. The palm support device of claim 12, wherein each of the two support pads has a concave upper surface.

14. The palm support device of claim 13, wherein each of the concave upper surfaces has an outermost edge higher than an inner edge.

15. The palm support device of claim 12, wherein each of the two support pads has a generally rounded rectangular main area and a wing extending outwardly and distally.

16. The palm support device of claim 1, wherein the hinge connecting the two support pads is lower than the upper surface of the two support pads, providing an air gap between the two support pads when spaced apart in the open configuration.

17. The palm support device of claim 1, wherein each underside having the low friction surface is formed from a material having a low coefficient of friction.

18. The palm support device of claim 17, wherein the material is one of polypropylene, polyethylene, and polytetrafluoroethylene.

19. A palm support device for use in supporting a heel of a user's hand while operating a hand-operated input device on a work surface, comprising:

a base portion having a left part and a right part spaced-apart and connected by a connecting web, wherein the base portion is integrally formed, the left part and the right part having an underside for contacting the work surface, and wherein the connecting web forms a living hinge to enable hinged movement of the left part and the right part between an open configuration in which the undersides are in a common plane and a closed configuration in which the undersides are brought into contact with each other;

a support pad portion having a left side and a right side spaced-apart and bonded atop the left part and the right part of the base portion, respectively, the left side and right side of the support pad portion each having an upper surface to contact and support, in use, a pisiform region of the hand and a trapezium region of the hand, respectively; and a latching mechanism for releasably maintaining the base portion in the closed configuration.

20. The palm support device of claim 19, wherein the living hinge is in a plane above the common plane and below the upper surface.

21. The palm support device of claim 19, wherein the upper surface of each of the left side and right side of the support pad portion is concave.

* * * * *